US005908116A

United States Patent [19]

Levaro et al.

[11] Patent Number: 5,908,116

[45] Date of Patent: Jun. 1, 1999

[54] MAIL ACCUMULATING DEVICE

[75] Inventors: Mauro Levaro, Genoa; Andrea Faeti, Mercato Saraceno; Michele Scarnera, Genoa, all of Italy

[73] Assignee: Finmeccanica S.p.A., Italy

[21] Appl. No.: 08/850,380

[22] Filed: May 2, 1997

[30] Foreign Application Priority Data

May 3, 1996 [IT] Italy ..... TO96A0358

[51] Int. Cl.[6] ..... B07C 5/00; B07C 5/02; B07C 5/342

[52] U.S. Cl. ..... 209/584; 271/3.03; 271/3.18; 271/262; 271/265.04; 209/900; 209/923; 198/460.3

[58] Field of Search ..... 271/3.03, 3.14, 271/3.18, 262, 265.04; 209/583, 584, 900, 923; 198/460.3, 462.2

[56] References Cited

U.S. PATENT DOCUMENTS

| | | | |
|---|---|---|---|
| 4,161,244 | 7/1979 | Hunter et al. | 198/347.4 |
| 4,273,326 | 6/1981 | Snellman et al. | 271/3.03 |
| 5,095,684 | 3/1992 | Walker et al. | 198/462.2 |
| 5,119,954 | 6/1992 | Svyatsky et al. | 209/584 |
| 5,433,325 | 7/1995 | Levaro et al. | 209/584 |

FOREIGN PATENT DOCUMENTS

| | | |
|---|---|---|
| 0429118 | 5/1991 | European Pat. Off. . |
| 0552778 | 7/1993 | European Pat. Off. . |
| 2650767 | 3/1991 | France . |

*Primary Examiner*—Tuan N. Nguyen
*Assistant Examiner*—Joe Dillon, Jr.
*Attorney, Agent, or Firm*—Palmatier, Sjoquist, Voigt & Christensen, P.A.

[57] ABSTRACT

A mail accumulating device having a number of stream forming units, each of which has a pair of powered belts superimposed at a point of contact defining the input of the unit. Each stream forming unit is provided with a sensor for detecting the passage of a mail item into the unit, and for generating a signal for activating the belts, thereby moving the mail items retained on the belts from the input to the output of the unit in discrete steps, and forming a group of overlapping mail items with the leading edges separated by a substantially constant distance. The device also includes a number of conveyor belt devices, each of which has an input communicating with the output of a respective stream forming unit, to enable the conveyor belt to receive a group of mail items at the input and feed the group of mail items to an output of the conveyor belt device to define an accumulating unit.

18 Claims, 5 Drawing Sheets

MAIL ACCUMULATING DEVICE

BACKGROUND OF THE INVENTION

The present invention relates to a mail accumulating device.

Mail sorting systems are known to comprise automatic reading devices supplied with a stream of mail items (letters and postcards), and which provide for automatically reading the address on the item, extracting any items with addresses not recognizable automatically, and supplying them to an accumulating device where the items are stored pending manual recognition of the address. Known accumulating devices, which normally store the items in containers into which the items are fed successively, are not very flexible, at times involve a certain amount of manual operating (e.g. to transport and/or unload the containers), and therefore provide for a poor degree of efficiency.

SUMMARY OF THE INVENTION

It is an object of the present invention to provide an accumulating device designed to accumulate the mail items and unload the accumulated items fully automatically.

A preferred, non-limiting embodiment of the present invention will be described by way of example with reference to the accompanying drawings, in which:

FIG. 2B shows a magnified view of the distance formed between adjacent mail items during movement through a sorting unit in the accumulating device;

FIG. 2C shows a magnified view of the distance formed between adjacent mail items during movement along an intermediate section of the accumulating device;

DETAILED DESCRIPTION OF THE INVENTION

Figure 1:
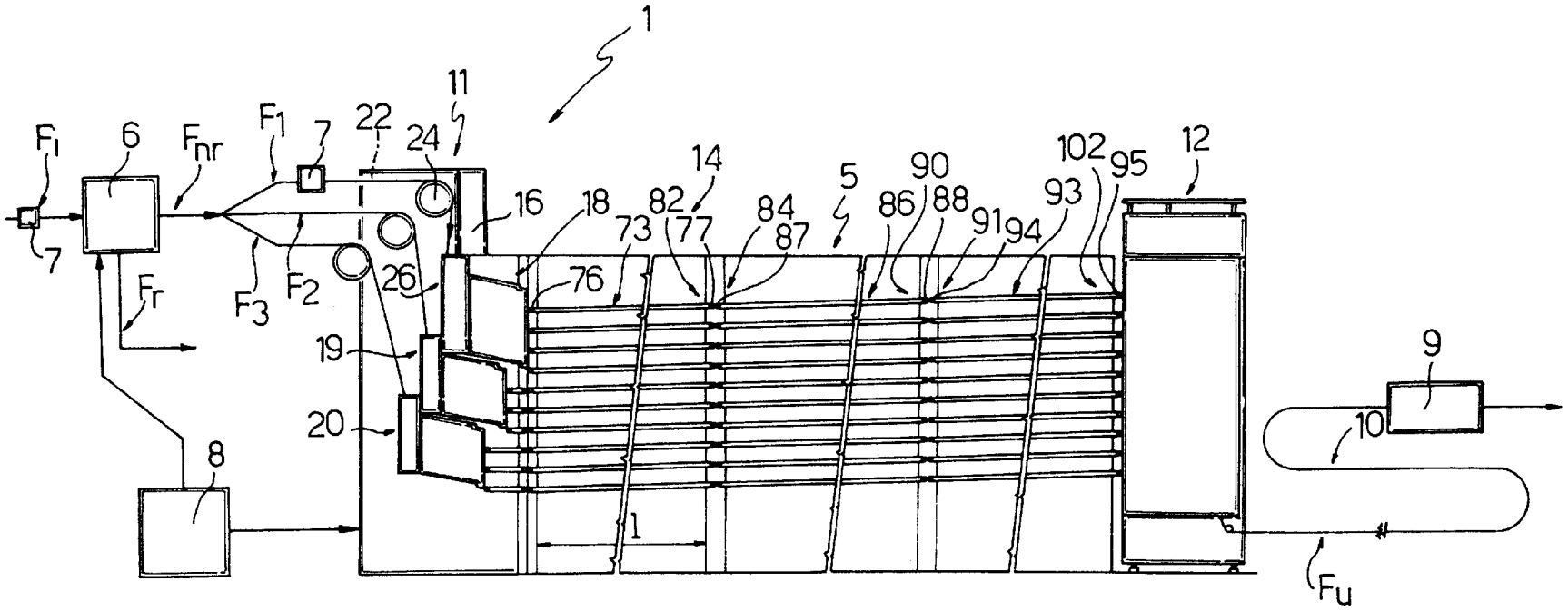
FIG. 1 shows an accumulating device in accordance with the teachings of the present invention.

Number 1 in FIG. 1 indicates a mail sorting system comprising a mail accumulating device 5 supplied with mail items from an automatic reading device 6 (shown schematically) in turn supplied with a stream Fi of mail items 7 (letters and postcards), and which provides for automatically reading the handwritten or typed address on the item. Automatic reading device 6 generates at the output a first stream Fr of items with automatically recognized addresses; and a second stream Fnr of items bearing addresses which have failed to be recognized automatically, and which is conveniently supplied to accumulating device 5 where the items are stored pending manual recognition of the address.

Accumulating device 5 and automatic reading device 6 are controlled by an electronic control unit 8 (shown schematically). Accumulating device 5 receives three separate streams F1, F2, F3 of mail items forming part of stream Fnr, and generates at the output a stream Fu of overlapping mail items, which is supplied, for example, to a separating device 9 (shown schematically) connected to accumulating device 5 by a conveyor belt system 10 (shown schematically).

As shown in FIG. 1, the accumulating device comprises an input section 11 receiving streams F1, F2, F3; an output section 12 generating stream Fu; and an intermediate accumulating section 14 interposed between input section 11 and output section 12.

Input section 11 comprises a vertical metal supporting structure 16 (shown schematically in FIG. 1) supporting three superimposed stream forming devices 18, 19, 20 supplied respectively with streams F1, F2, F3. More specifically, stream F1 travels along a horizontal portion 22 (FIG. 2A) of input section 11, and is then diverted downwards towards forming device 18 by a pulley 24 supporting two superimposed belts (not shown) for retaining the items in stream F1. Stream F1 is thus supplied to a sorting unit 26 forming part of forming device 18, and which directs the items in stream F1 to first, second, third and fourth stream forming units 27*a*, 27*b*, 27*c*, 27*d*. Sorting unit 26 is of known type, and comprises first, second, third and fourth blade selecting devices 30*a*, 30*b*, 30*c*, 30*d* connected respectively to forming units 27*a*, 27*b*, 27*c*, 27*d* and aligned in a vertical direction parallel to stream F1 inside sorting unit 26. Each blade selecting device 30*a*, 30*b*, 30*c*, 30*d* is moved by a respective electric actuator (not shown) between a first activated position, to intercept and feed the items in stream F1 to a respective forming unit 27*a*, 27*b*, 27*c*, 27, and a second release position enabling the items to travel on to the next selecting device. Each blade selecting device 30*a*, 30*b*, 30*c*, 30*d* cooperates with a pair of powered roller 31*a*, 31*b* located to the side of the blade selecting device, between this and the respective forming unit.

Figure 2A:
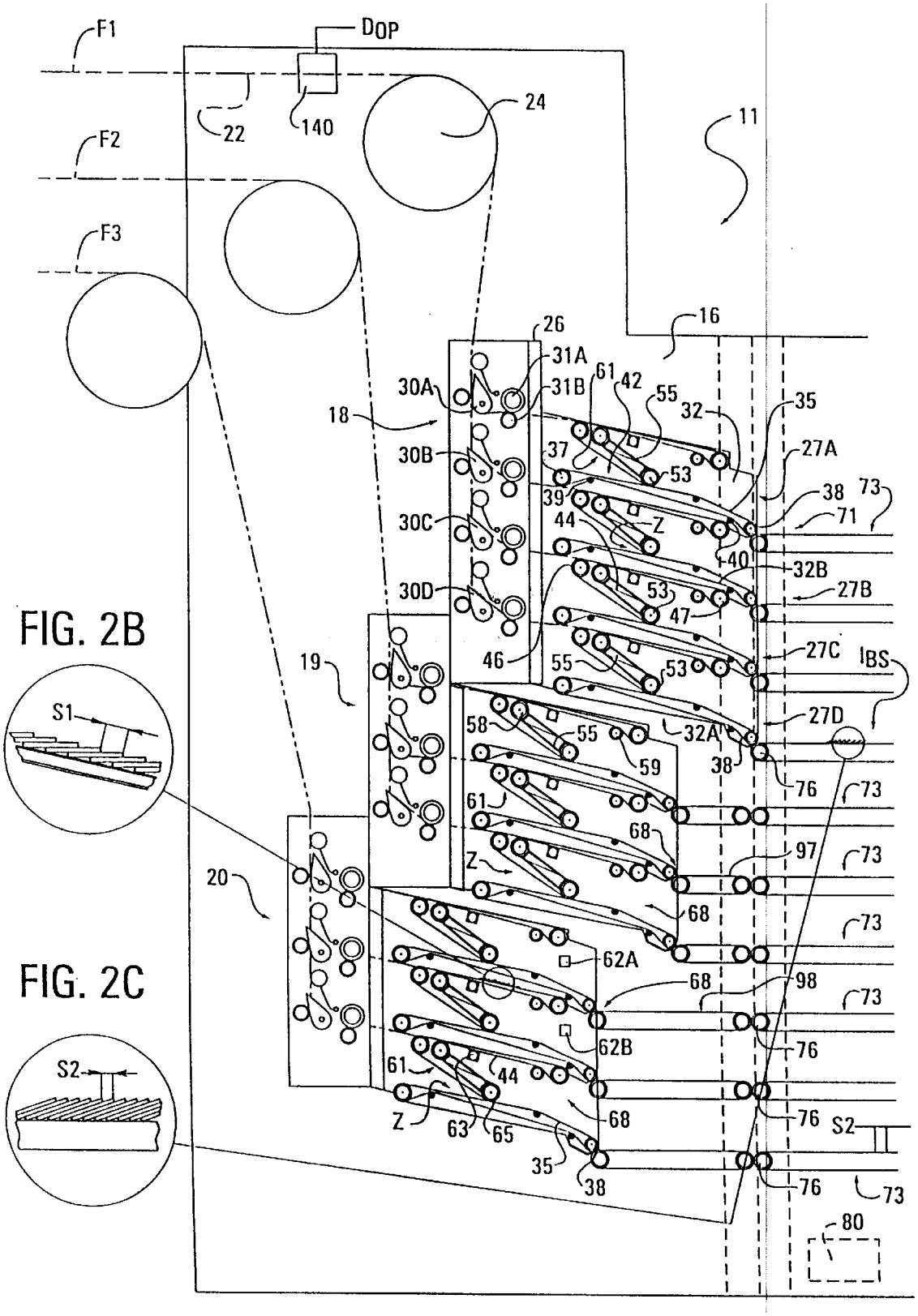
FIG. 2A shows a larger-scale view of a first portion of the FIG. 1 accumulating device.

As shown in FIGS. 1 and 2A, each stream forming unit 27 is fitted to a substantially rectangular metal plate 32, and comprises a first belt 35 defining an endless path extending between two pulleys 37, 38 located close to adjacent corners of plate 32 and cooperating with the inner surface of belt 35. Belt 35 also cooperates with three tensioning pulleys 39, 40, 41 located along a first long side 32*a* of late 32, and which press on the outer and inner surfaces of belt 35 to form a substantially straight portion 42 of belt 35 extending between pulley 37 and pulley 41. Sorting unit 26 also comprises a second belt 44 defining an endless path, and the inner surface of which cooperates with two pulleys 46, 47 located along a second long side 32*b* of plate 32, and with a third pulley 53 fitted to a first end of an arm 55, the second end of which is hinged to plate 32. Pulleys 46, 47 and 53 are substantially located at the vertices of an isosceles triangle, with pulley 53 adjacent to straight portion 42 of belt 35. The second belt 44 also cooperates with tensioning pulleys 58, 59 located respectively on the second end of arm 55 and close to pulley 47, and which press on the outer surface of belt 44. Belt 44 defines, among other things, a straight portion 61 extending between pulleys 46 and 53 and terminating at a point Z at which belt 44 contacts straight portion 42, and which defines the input of forming unit 27. Belts 35 and 44 are operated by respective drive devices 62*a*, 62*b* (shown schematically) controlled by electronic unit 8, and which provide for moving belts 35 and 44 as described later on. Each forming unit 27 also comprises a first optoelectronic sensor 63, in turn comprising a photoemitting device (not shown) and a photoreceiving device (not shown) defining an optical path 65, which extends close to the point of contact Z of belts 35 and 44, and is interrupted by the entry of a mail item into forming unit 27. Each forming unit also comprises an output 68 defined by an end portion of belt 35 close to pulley 38.

Forming devices 19 and 20 are structured in exactly the same way as forming device 18 described above, except that devices 19 and 20 comprise three sorting units 26 and three forming units 27 as opposed to four, and each sorting unit 26 comprises three blade selecting devices 30.

According to the present invention, output 68 of each forming unit 27 of forming device 18 communicates with the input 71 of a first straight conveyor belt 73 forming part of accumulating section 14 and extending between two pulleys 76, 77, at least one of which is a drive pulley operated by drive means 80 controlled by electronic unit 8. Pulley 76 is located adjacent to and below pulley 38, so that the mail items coming off belt 35 are deposited on to belt 73; and belt 73 is moved by drive means 80 towards the output section in discrete steps S2 of predetermined length (e.g. 5 mm) and at constant speed (see FIG. 2C).

As shown particularly in FIG. 1, belt 73 comprises an output 82 communicating with the input 86 of a second straight conveyor belt 86 forming part of accumulating section 14 and extending between two pulleys 87, 88, at least one of which is a drive pulley operated by respective drive means (not shown) controlled by electronic unit 8. Pulley 87 is located adjacent to pulley 77, so that the mail items coming off belt 73 are deposited on to belt 86; and belt 86 is moved (in the same direction as belt 73) by the drive means (not shown) in steps S2 of predetermined length and synchronized with the steps of belt 73. Belt 86 comprises an output 90 communicating with the input 91 of a third straight conveyor belt 93 forming part of accumulating section 14 and extending between two pulleys 94, 95, at least one of which is a drive pulley operated by respective drive means (not shown) controlled by electronic unit 8. Pulley 94 is located adjacent to pulley 88, so that the mail items coming off belt 86 are deposited on to belt 93; and belt 93 is moved (in the same direction as belts 73 and 86) by the drive means (not shown) in steps S2 of predetermined length and synchronized with the steps of belts 73 and 86.

Similarly, forming units 27 of forming devices 19 and 20 also communicate with successive adjacent first, second and third belts structured and operating in exactly the same way as belts 73, 86 and 93. In addition, forming units 27 of forming device 19 (FIG. 2) cooperate with respective straight auxiliary belts 97, each interposed between output 68 of the forming unit and the input of first conveyor belt 73; and, similarly, forming units 27 of forming device 20 (FIG. 2A) cooperate with respective straight auxiliary belts 98, each interposed between output 68 of the forming unit and the input of first conveyor belt 73. Auxiliary belts 97 and 98 move in successive steps S2 in time with the first, second and third conveyor belts (see FIG. 2C).

Figure 3:
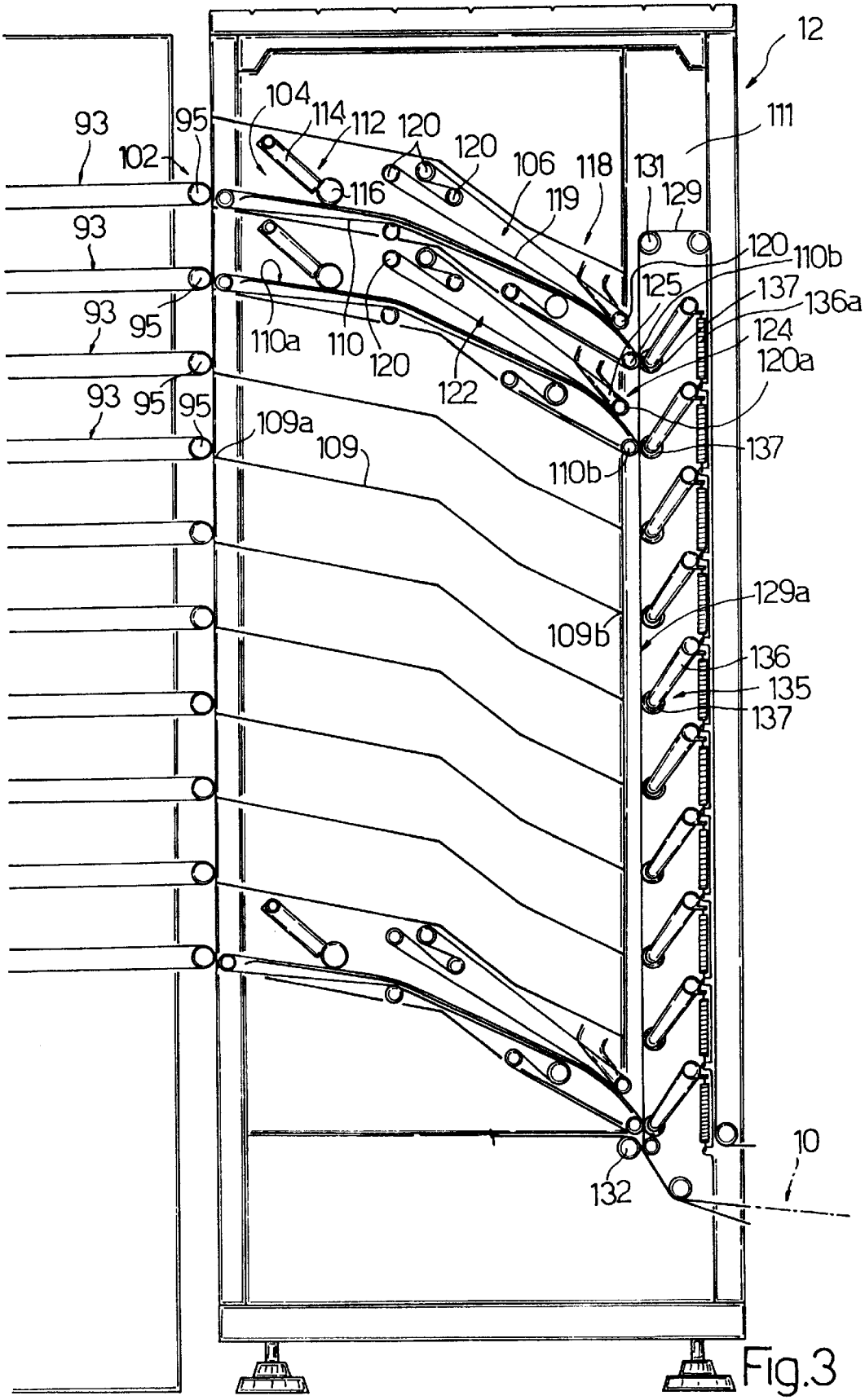
FIG. 3 shows a larger-scale view of a second portion of the FIG. 1 accumulating device.
Figure 4:
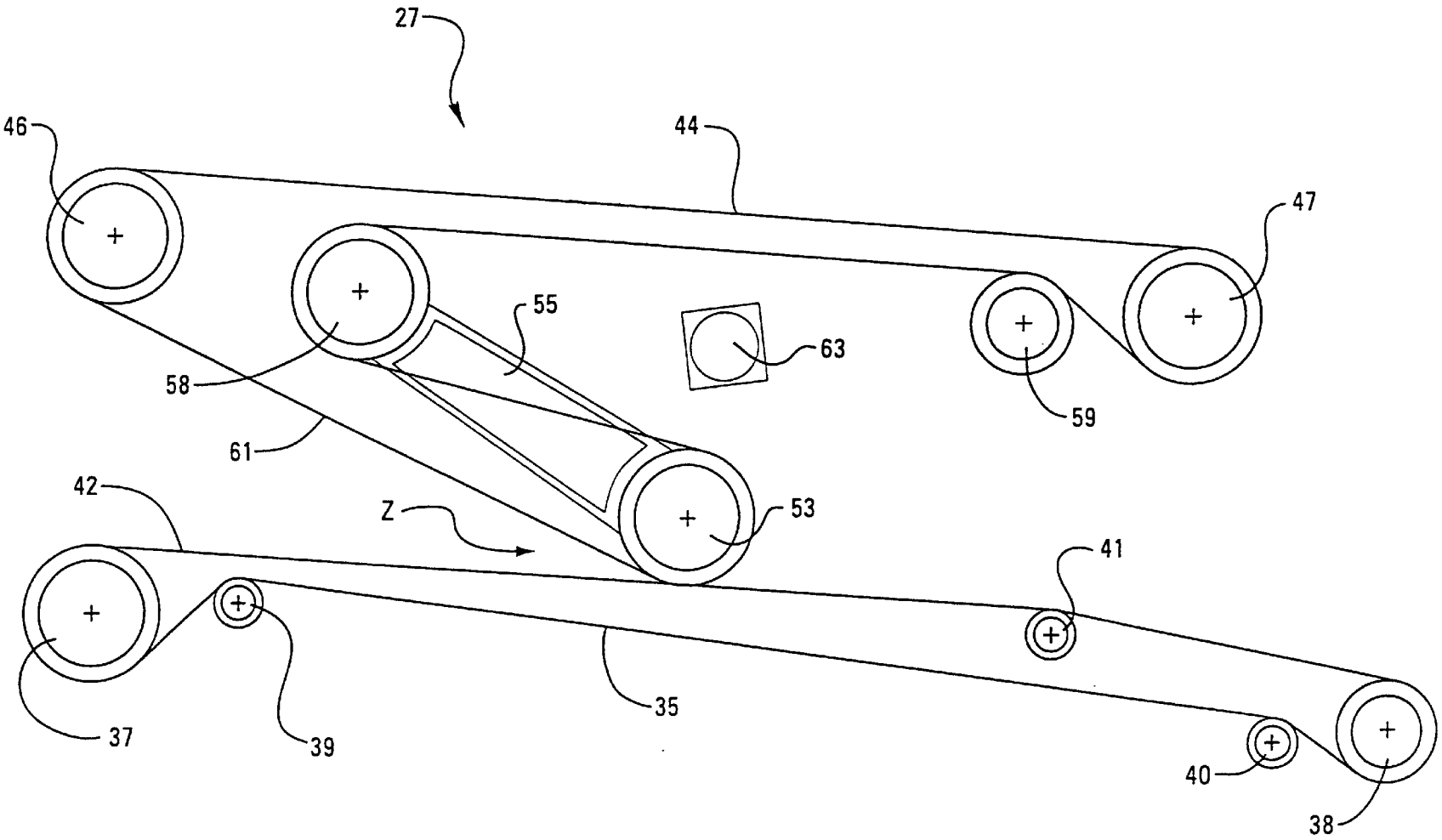
FIG. 4 shows a detailed view of a single sorting unit of the FIG. 1 accumulating device.
Figure 5:
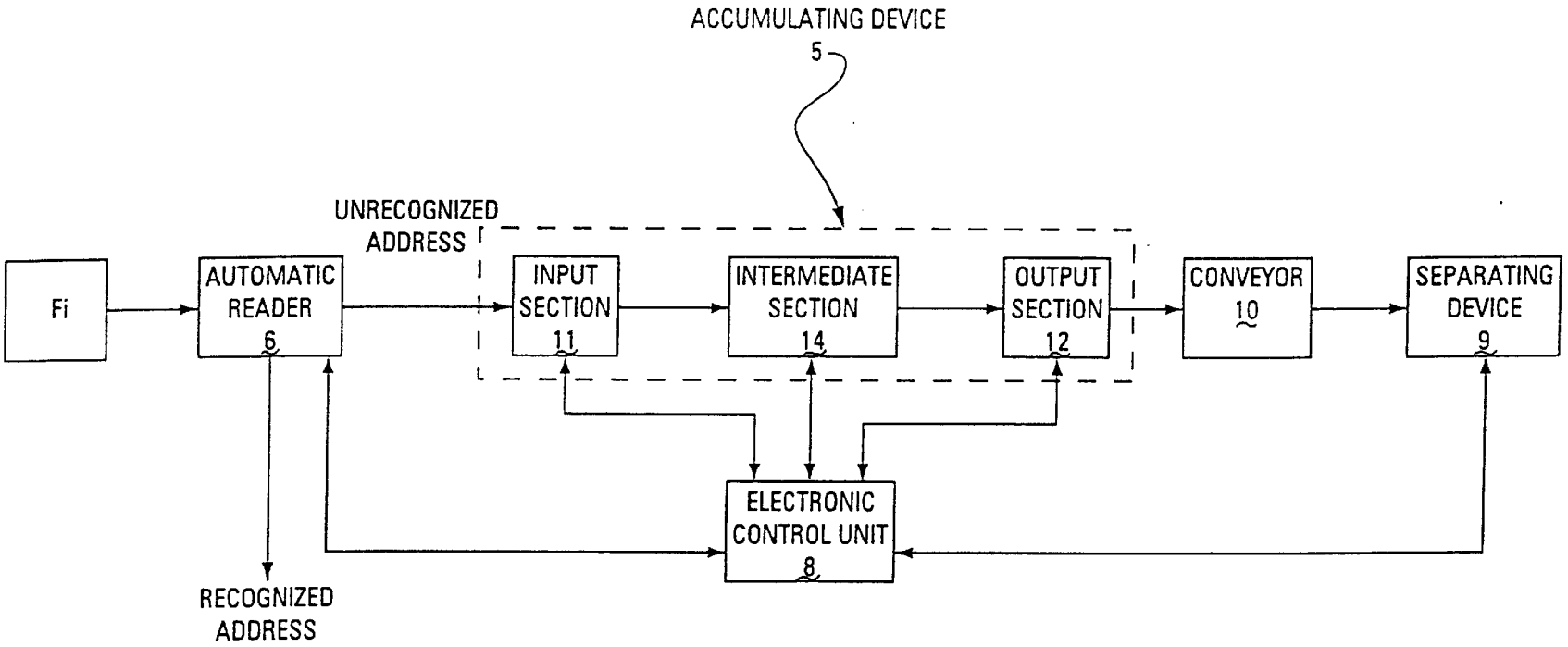
FIG. 5 shows the FIG. 1 accumulating device in schematic form.

At pulley 95, each belt 93 (FIG. 3) defines an output 102 communicating with the input 104 of a conveying device 106, which, among other things, comprises a rectangular chute-like blade 109 projecting from a vertical wall 111 of output section 12, and comprising a first top end portion 109*a* adjacent to pulley 95, and a second bottom end portion 109*b*. Blade 109 cooperates with a powered conveyor belt 110, which rests on the upper face of blade 109, from portion 109*a* to portion 109*b*, to define a conveying portion 110*a*, which terminates as belt 110 rotates about a pulley 110*b* adjacent to bottom end portion 109*b*. belt 110 is also supported on a number of tensioning pulleys located beneath blade 109.

Conveying device 106 also comprises a pressing device 112, which in turn comprises a straight arm 114 having a first end portion connected to an elastic system (not shown) fitted to wall 111, and a second end portion fitted with an idle pressure roller 116, which rests on an initial portion of belt 110 close to top end portion 109*a*. Conveying device 106 also comprises an end guide device 118 in turn comprising a belt 119 extending along an endless path defined by a number of pulleys 120. More specifically, belt 119 defines a straight portion 122 extending between a pulley 120 facing blade 109, and a point at which belt 119 contacts belt 110 close to bottom end portion 109*b*. The end guide device also comprises a tensioning device 124, in turn comprising a straight arm 125 having a first end portion connected to an elastic system (not shown) fitted to wall 111, and a second end portion fitted with an idle roller 120*a* for pressing belt 119 on to belt 110.

Conveying devices 106 cooperate with a transportation device comprising a conveying belt 129 extending along a substantially rectangular endless path comprising a straight vertical portion 129*a* extending adjacent to all the bottom end portions 109*b* of blades 109, between a top pulley 131 and a bottom pulley 132. Belt 129 is moved downwards, i.e. from pulley 131 to pulley 132, at constant speed by drive means (not shown), and cooperates with a number of tensioning devices 135 located inside the rectangular perimeter of belt 129, and each comprising a straight arm 136 having a first end portion connected to an elastic device 136*a*, and a second end portion fitted with an idle roller 137 cooperating with an inner portion of belt 129 to push belt 129 towards belt 110 rotating about pulley 110*b*.

Conveyor belt system 10 defines a path (curved in the FIG. 1 embodiment, but which may also be straight) of a length L at least equal to the length l of first straight conveyor belt 73 ($L \geqq l$).

In actual use, the mail items in each of streams F1, F2, F3, e.g. stream F1, are fed to a sorting unit 26 of a forming device, e.g. forming device 18. In the following description, reference will therefore be made to forming device 18, through the operations described obviously also apply to forming device 19 or 20. The mail items are therefore fed to the first selecting device, which, in said first position, feeds the items into forming unit 27*a*. If the selecting device is set to the second position, the mail items are fed to the next selecting device 30*b*, in which the above operations are repeated to feed the items into forming unit 27*b* or to the next selecting device. The last selecting device 30*d* acts as a fixed guide, but which anyway provides for feeding the mail items into the adjacent forming unit 27*d*.

When fed to a forming unit 27, the mail item slides along a lateral wall of the selecting device to rollers 31*a*, 31*b*, which grip the item and feed it to input Z of forming unit 27. The mail item travels along a parabolic trajectory, which intersects optical path 65 and terminates when the leading edge of the item is inserted between belts 35 and 44 with a small portion of the item beneath pulley 53. The interruption of optical path 65 is detected by electronic control unit 8, which activates drive devices 62*a*, 62*b* so that belts 35 and 44 move one step S1 of predetermined length, e.g. 10 mm as depicted in FIG. 2B, in the same direction and at constant speed, and the first item fed into forming unit 27 is positioned between belts 35 and 44 and fed by a length S1 towards output 68.

When the next item is fed into unit 27, the above operations are repeated, so that the first item, already positioned between belts 35 and 44, is fed further towards output 68 by a distance substantially equal to S1, and the second item is superimposed on the first with its leading edge separated from the leading edge of the first item by a distance substantially equal to S1. The above operations are repeated for all the items fed into unit 27, so as to form a group Ibs of overlapping items aligned in a straight direction and resting on straight portion 42, and which gets longer and moves towards output 68 as further items are fed into unit 27.

On reaching output 68, group Ibs is fed on to first belt 73, which moves in successive steps S2 synchronized with but smaller than steps S1 (e.g. S1=10 mm and S2=5 mm), so that group Ibs travels on belts 73, 86, 93 at a slower speed than that at which it leaves forming unit 27, and therefore gets thicker as it is transferred from forming unit 27 to belts 73, 86, 93, thus enabling a large number of items to be retained in intermediate section 14.

In the case of forming devices 19 and 20, groups Ibs also travel along auxiliary belts 97 and 98 between forming units 27 and respective first belts 73.

Groups Ibs therefore travels along first belt 73 on to second belt 86, and from thereon to third belt 93, and engagement of belts 73, 86, 93 is detected by optical sensors (not shown) located at opposite ends of the belts. Belts 73, 86, 93 therefore act as an accumulating unit for housing the group Ibs of overlapping items formed by unit 27 and expelled from output 68; and the group Ibs formed in unit 27 gets longer as further items are fed into forming unit 27, and moves towards output 102 of the last belt (the third in the example shown). Filling of the accumulating unit defined by belts 73, 86, 93 terminates when the leading edge of the first item in group Ibs reaches output 102 of belt 93, at which point group Ibs extends along the whole length of intermediate accumulating section 14. To unload group Ibs from intermediate accumulating section 14, electronic unit 8 operates belts 73, 86, 93 continuously at constant speed to feed group Ibs to output section 12 through output 102 and on the belt 110 traveling in the same direction as belts 73, 86, 93. As it is moved along by belt 110, group Ibs is engaged by pressure roller 116 of pressing device 112 to hold the items down; and, at the end of belt 110, group Ibs is fed beneath belt 119, which pushes the items towards vertical portion 129*a* where group Ibs makes a sharp turn and is fed vertically downwards by belt 12. When unloaded off belt 129, group Ibs is fed on to conveyor belt system 10 to form the output stream Fu generated by accumulating device 5.

By the time group Ibs is transferred from intermediate section 14 to conveyor belt system 10, first belt 73, which, as stated, is of a length l equal to or less than the length of system 10, has definitely been cleared.

Device 5 therefore requires no manual operation, by virtue of conveying the mail items, forming groups Ibs of overlapping items, storing and conveying groups Ibs along intermediate section 14, and unloading groups Ibs fully automatically, and is therefore highly flexible, and provides for a high degree of efficiency.

Clearly, changes may be made to the accumulating device as described and illustrated herein without, however, departing from the scope of the present invention.

For example, the accumulating device (FIG. 2A) may comprise a scanning device 140 (shown schematically) located along horizontal portion 22 to measure (in known manner, e.g. by means of laser techniques) the Dop thickness of individual mail items 7 supplied to forming device 18; and the Dop thickness value may conveniently be supplied to electronic control unit 8 to so control drive devices 62*a*, 62*b* as to regulate step S1 according to the measured Dop thickness, an so obtain a group Ibs of substantially constant thickness.

As opposed to a single output communicating with conveyor belt system 10, as in the example shown, output section 12 may comprise two outputs to increase the number of mail items unloaded per unit of time off accumulating device 5.

We claim:

1. A device for accumulating mail items, the device comprising a number of stream forming units (27), each receiving a stream (F1, F2, F3) of mail items (7); each stream forming unit (27) comprising conveyor belt means (35, 44) moved by first drive means (62*a*, 62*b*) and for retaining the mail items supplied to the stream forming unit and feeding the retained mail items along a path (42) extending between an input (Z) and an output (68) of said stream forming unit (27);

each stream forming unit (27) also comprising sensor means (63) for detecting the passage of a mail item (7) into the stream forming unit, so as to generate an enabling signal for activating said first drive means (62*a*, 62*b*) and moving the mail items contained in said stream forming unit from said input (Z) to said output (68) in discrete steps (S1) performed at each enabling signal, and so form a group (Ibs) of overlapping mail items aligned along said conveyor belt means (35, 44), and having respective leading edges separated by a given distance (S1) and, further;

comprising a number of conveying devices (73, 86, 93), each having an input (71) communicating with an output (68) of a respective stream forming unit (27); said conveying devices (73, 86, 93) being moved by second drive means (80), and each receiving a said group (Ibs) of overlapping mail items at the input (71) to feed said group (Ibs) of overlapping mail items to an output (102) of said conveying device (73, 86, 93) to define an accumulating unit containing said group (Ibs) of overlapping mail items traveling along the conveying device.

2. A device as claimed in claim 1, characterized in that each conveying device comprises at least one conveyor belt (73, 86, 93) moved by said second drive means (80) and having an input (71) communicating with a respective output (68) of a said stream forming unit (27).

3. A device as claimed in claim 1, characterized in that each conveying device comprises a number of conveyor belts (73, 86, 93) arranged in series and moved in the same direction by said second drive means (80); a first conveyor belt of said number having an input (71) communicating with a respective output (68) of a said stream forming unit (27).

4. A device as claimed in claim 1, characterized in that each conveying device (73, 86, 93) is moved in successive discrete steps (S2) controlled by said second drive means (80).

5. A device as claimed in claim 4, characterized in that said second drive means move said conveying device in discrete steps (S2) synchronized with said discrete steps (S1) in which said conveyor belt means (35, 44) are moved by said first drive means (62*a*, 62*b*).

6. A device as claimed in claim 1, characterized in that said first drive means (62*a*, 62*b*) move said conveyor belt means (35, 44) in first discrete steps (S1), and said conveying devices (73, 86, 93) are moved by said second drive means (80) in second discrete steps (S2); said second discrete steps (S2) being smaller than said first discrete steps (S1).

7. A device as claimed in claim 1, characterized in that the conveyor belt means (35, 44) comprise at least a first belt (35) and a second belt (44) activated by respective drive means (62*a,* 62*b*);

said first belt (35) comprising at least one substantially straight portion (42) defining at least part of said path; said second belt (44) comprising a portion (61) terminating at a point of contact (Z) with said substantially straight portion (42); said point of contact (Z) defining said input of said stream forming unit (27); and said first and second belts (35, 44) being moved in the same direction and in discrete steps (S1) upon reception of said enabling signal.

8. A device as claimed in claim 7, characterized in that said second belt (44) is supported by at least three pulleys (46, 47, 53) located at the vertices of a triangle and cooperating with an inner surface of said second belt; one (53) of said three pulleys being fitted to a free end of an arm (55) connected to elastic means and for pressing said pulley (53) on to said substantially straight portion (42) of said first belt (35) to define said point of contact (Z).

9. A device as claimed in claim 1, further comprising sorting means (26) connected to said stream forming units (27); said sorting means (26) receiving a stream (F1, F2, F3) of mail items and directing said mail items to the various stream forming units (27).

10. A device as claimed in claim 2, characterized in that said sorting means (26) comprise a number of selectors (30) for successively intercepting the mail items in said stream; each said selector (30) being movable between an activated position to intercept and feed the mail items (7) in said stream to a respective stream forming unit (27), and a release position for feeding the stream of mail items to the next selector (30).

11. A device as claimed in claim 1, further comprising an output section (12) in turn comprising a common transportation device (129) communicating at the input with said outputs (102) of said conveying devices (73, 86, 93); said common transportation device (129) receiving said groups (Ibs) of overlapping mail items from said conveying devices (73, 86, 93).

12. A device as claimed in claim 11, characterized in that said output section (12) comprises a number of conveying means (106), each interposed between an output (102) of a conveying device (73, 86, 93) and said common transportation device (129).

13. A device as claimed in claim 12, characterized in that each conveying means (106) comprises a chute-like blade (109) having a top end portion (109*a*) adjacent to said output (102) of said conveying device (73, 86, 93), and a bottom end portion (109*b*) facing a portion of said common transportation device (129); said chute-like blade (109) being connected to a first powered conveyor belt (110) defining a conveying portion (110*a*) extending adjacent to said chute-like blade, from said top end portion (109*a*) to said bottom end portion (109*b*).

14. A device as claimed in claim 13, characterized in that each conveying means (106) also comprises a pressing device facing said chute-like blade (109) and having at lest an idle pressure roller (116) contacting said first powered conveyor belt (110) close to said top end portion (109*a*).

15. A device as claimed in claim 13, characterized in that each conveying means (106) also comprises an end guide device (118) in turn comprising a second powered conveyor belt (119) defining at least a straight portion (122) facing said chute-like blade (109) and contacting said first powered conveyor belt (110) close to said bottom end portion (109*b*) of said chute-like blade (109).

16. A device as claimed in claim 13, characterized in that said common transportation device comprises a third powered conveyor belt (129) defining at least a straight portion (129*a*) facing said bottom end portions (109*b*) of said chute-like blades (109).

17. A device as claimed in claim 1, further comprising scanning means (140) for measuring the thickness (Dop) of individual mail items (7) entering the stream forming units (27); said accumulating device (5) comprising electronic control means (8) receiving at least one quantity related to said thickness (Dop), and generating a signal for so controlling said first drive means (62*a,* 62*b*) as to regulate the size of said discrete step (S1) according to the measured thickness (Dop) and so obtain a group (Ibs) of overlapping mail items of substantially constant thickness.

18. A device as claimed in claim 1, characterized in that said conveying devices (73, 86, 93) communicate at the output (102) with a conveying system (10) extending from said accumulating device (5) and for conveying groups (Ibs) of overlapping mail items;

each said conveying device (73, 86, 93) comprising at least a first conveying portion (73) communicating at the input (71) with the output (68) of a respective stream forming unit (27), and a second conveying portion (86, 93) connected in series with said first conveying portion (73) and having an output (102) defining the output of the conveying device; said conveying system (10) defining a path of a length (L) at least equal to the length of said first conveying portion (73).

* * * * *

UNITED STATES PATENT AND TRADEMARK OFFICE

CERTIFICATE OF CORRECTION

PATENT NO. : 5,908,116
DATED : Jun. 1, 1999
INVENTOR(S) : Mauro Levaro, Andrea Faeti, Michele Scarnera It is certified that error appears in the above-identified patent and that said Letters Patent is hereby corrected as shown below:

On the title page: Item [75]
Inventors: please delete the word "Genoa" and in its place insert --Genova- Col. 2, line 30: Please delete the word "roller" and in its place insert--rollers--

Col. 3, line 18: please delete the word "86" and insert in its place --84--

Col. 3, line 61: delete the word "belt" and insert in its place --Belt--

Col. 4, line 37: delete the word "through" and insert in its place --though--

UNITED STATES PATENT AND TRADEMARK OFFICE

CERTIFICATE OF CORRECTION

PATENT NO. : 5,908,116

DATED : June 1, 1999

INVENTOR(S) : Mauro Levaro, Andrea Faeti, Michele Scarnera

It is certified that error appears in the above-identified patent and that said Letters Patent is hereby corrected as shown below:

Col. 5, line 18: please delete "Groups" and insert in its place --Group --

Col. 5, line 19: delete the word "thereon" and insert in its place --there on--

Col. 5, line 35: please delete the word "the" where it first appears and in its place insert --to--

Col. 5, line 41: delete the word "12" and insert in its place --129--

Col. 6, line 26: please delete the phrase "(57) and, further;" and insert in its place --(57); and, further--

Col. 8, line 8: please delete the word "lest" and insert in its place --least--

Signed and Sealed this

Eighteenth Day of July, 2000

*Attest:*

*Attesting Officer*

Q. TODD DICKINSON

*Director of Patents and Trademarks*